United States Patent [19]

Fischer

[11] Patent Number: 4,788,912

[45] Date of Patent: Dec. 6, 1988

[54] VERSATILE PRINTING MACHINE SYSTEM PERMITTING PLATE CHANGE DURING MACHINE OPERATION

[75] Inventor: Hermann Fischer, Augsburg, Fed. Rep. of Germany

[73] Assignee: M.A.N. Roland Druckmaschinen AG, Offenbach am Main, Fed. Rep. of Germany

[21] Appl. No.: 31,700

[22] Filed: Mar. 27, 1987

[30] Foreign Application Priority Data

Apr. 25, 1986 [DE] Fed. Rep. of Germany ..... 3614030

[51] Int. Cl.[4] ..... B41F 5/16; B41F 7/04

[52] U.S. Cl. ..... 101/177; 101/180; 101/181; 101/221

[58] Field of Search ..... 101/177, 178, 179, 180, 101/181, 182, 185, 220, 221, 225, 137, 138, 139, 140, 143, 144, 145, 247

[56] References Cited

U.S. PATENT DOCUMENTS

| | | | |
|---|---|---|---|
| 3,593,987 | 7/1971 | Garber | 101/226 X |
| 4,218,972 | 8/1980 | Fujishiro | 101/182 X |
| 4,250,809 | 2/1981 | Pullen | 101/177 |
| 4,369,705 | 1/1983 | Gelinas | 101/182 X |
| 4,442,773 | 4/1984 | Kobayashi | 101/182 X |
| 4,526,099 | 7/1985 | Niemiro et al. | 101/220 |

FOREIGN PATENT DOCUMENTS

| | | | |
|---|---|---|---|
| 1827845 | 5/1961 | Fed. Rep. of Germany . | |
| 1238929 | 4/1967 | Fed. Rep. of Germany . | |
| 2134397 | 1/1972 | Fed. Rep. of Germany | 101/177 |
| 2409219 | 9/1975 | Fed. Rep. of Germany | 101/179 |
| 2844418 | 4/1980 | Fed. Rep. of Germany . | |
| 3220542 | 12/1983 | Fed. Rep. of Germany | 101/221 |
| 0208112 | 3/1984 | German Democratic Rep. | 101/178 |

*Primary Examiner*—Clifford D. Crowder

*Attorney, Agent, or Firm*—Frishauf, Holtz, Goodman & Woodward

[57] ABSTRACT

To provide for versatile printing, while permitting exchange of the plate of a blanket cylinder - plate cylinder couple during operation of the printing machine, i.e. while the machine is printing, for example only prime or verso printing in a single color, two blanket cylinder - plate cylinder (2, 4; 3, 5) are provided, selectively engageable with an impression cylinder (1). One (3) of the blanket cylinders is positionable in three axial positions, selectively (a) for engagement with the impression cylinder (1), (b) for engagement with the other blanket cylinder (2) or (c) removed from both the impression and the blanket cylinder, to permit exchange of the plate of the associated plate cylinder (5). A paper web substrate (6) can be passed, selectively, between the two blanket cylinders and partially about the impression cylinder, or between the impression cylinder and one of the blanket cylinders.

12 Claims, 10 Drawing Sheets

4
2
1
2'
2"
8
9
14
7
6
1'
3'
3
3"
3'''
5

VERSATILE PRINTING MACHINE SYSTEM PERMITTING PLATE CHANGE DURING MACHINE OPERATION

REFERENCE TO RELATED PUBLICATIONS

German Utility Model DE-GM No. 18 27 845, May 1959, Schluckebier. German Pat. No. 1,238,929, April 1967, Bolza-Schunemann et al. German Pat. No. DE 28 44 418, pub. Apr. 1980, Puschnerat et al. Reference to related applications, assigned to the assignee of the present application, the disclosures of which are hereby incorporated by reference:

U.S. Ser. No. 07/035,616, filed Apr. 3, 1987, Theilacker et al now U.S. Pat. No. 4,753,168, June 28, 1988;

U.S. Ser. No. 07/040,635, filed Apr. 21, 1987, Liebert et al.

The present invention relates to printing machines, and more particularly to a printing machine system in which blanket cylinders - plate cylinder couples are provided, and so located with respect to an impression cylinder, the shaft of which is placed in a fixed location in the frame of the machine, that the respective blanket cylinders can be shifted in selected positions to permit various printing modes and, also, exchange of plates on the plate cylinders while a particular blanket - plate cylinder couple is stopped but another such couple continues to operate, thus permitting continued printed production during exchange of a plate.

BACKGROUND

It has previously been proposed to so arrange printing cylinders on a printing machine that, respectively, prime-and-verso or double prime printing is possible. One such arrangement is shown in German Pat. No. 28 44 418. An impression cylinder is used which is of double diameter with respect to the cylinders of two blanket cylinder - plate cylinder couples. The machine is so arranged that the respective couples can be placed in circumferential engagement, individually, on the double-sized impression cylinder. Each one of the blanket cylinders, thus, with respect to the common impression cylinders, has two positions, namely an engaged and a removed position.

German Pat. No. 1,238,929 describes a customary, now well known five-cylinder printing system which has a common impression cylinder and two blanket cylinder - plate cylinder couples. One of the blanket cylinders can be shifted through three axial positions. The printing system does not permit, however, exchange of a plate during operation of the machine. In this system, it is not possible to selectively engage a blanket cylinder on the impression cylinder while the machine is operating.

German Utility Model No. 1,827,845 describes—particularly in FIGS. 3 and 4—a printing machine arrangement in which a web can be selectively printed either with double prime printing or prime-and-verso printing.

THE INVENTION

It is an object to provide a printing machine system which is highly versatile, so that either prime-and-verso printing (1/1), dual color prime printing (2/0), or single prime printing on either side (1/0 or 0/1) is possible, in which, additionally, ghosting upon prime-and-verso printing is to be avoided, and, further, which permits flying plate change, that is exchange of printing plates on the respective plate cylinders while another plate cylinder couple continues to print in a selected mode in which the couple on which the plate is being exchanged is not needed.

Briefly, the cylinders, which are of the same diameter, are so arranged that one of the blanket cylinders can be shifted through three axial positions for, selectively:

(a) engagement against a common impression cylinder; or (b) engagement on another oppositely located blanket cylinder; or (c) a removed position, in which it is removed from both the impression cylinder as well the opposite blanket cylinder. The paper web can be guided either between the two blanket cylinders or between one of the blanket cylinders and the impression cylinder; for example when both blanket cylinders are engaged with each other, and one of the blanket cylinders, additionally, is engaged with the common impression cylinder.

While it is not absolutely necessary, the impression cylinder preferably should have the same diameter as the two blanket cylinders. The impression cylinder may have a cleaning or washing arrangement engaged thereon and may be covered with a rubber blanket. The impression cylinder can also be arranged to provide for circumferential or axial perforating strips.

The system can be expanded by adding further blanket cylinder - plate cylinder couples, since space therefor is available.

The system has the advantage that a minimum of shifting positions are needed for a highly versatile system. The impression cylinder is retained in one fixed position in the frame of the machine. One of the blanket cylinders need have only two selectively shiftable positions - engaged and disengaged; the other blanket cylinder requires only three respective operating positions, shiftable independently of the one blanket cylinder. In accordance with relative respective positions, three or four operating modes are then possible.

DRAWINGS

FIGS. 1–4 show a five-cylinder printing system in different operating modes with different paper paths therethrough;

FIG. 5 schematically shows a nine-cylinder printing system with one selected paper path;

FIGS. 6 through 10 show a seven-cylinder printing system with different selected paper paths.

In all the drawings, the printing application is indicated by small triangles, showing how many printing impressions can be applied at the respective sides of a paper web.

DETAILED DESCRIPTION

An impression cylinder 1 has a central shaft, shown schematically at 1', located in a fixed position in a frame (not shown, and for example of standard construction). In the description to follow, the shafts of the respective cylinders are shown only schematically by small cross marks since the present invention is not directed to the specific shaft construction but, rather, to the position of the cylinders with respect to each other, which, of course, are determined by the cylinder axes, indicated by the respective cross marks. Different shifted locations may be indicated by prime notation. Shifting of the shafts of the cylinders can be done, as well known, by locating the cylinders for example in eccentrically positioned bearings.

Figure 2:
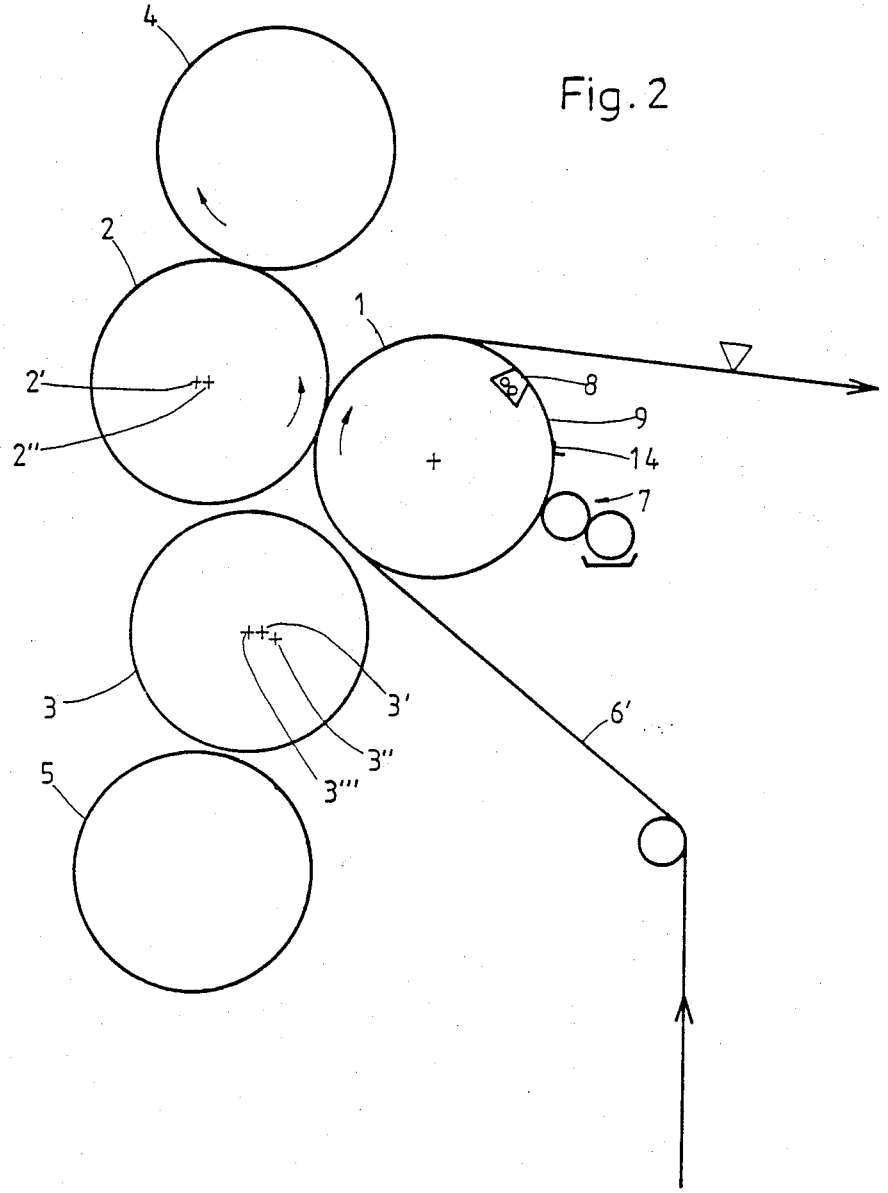
Figure 3:
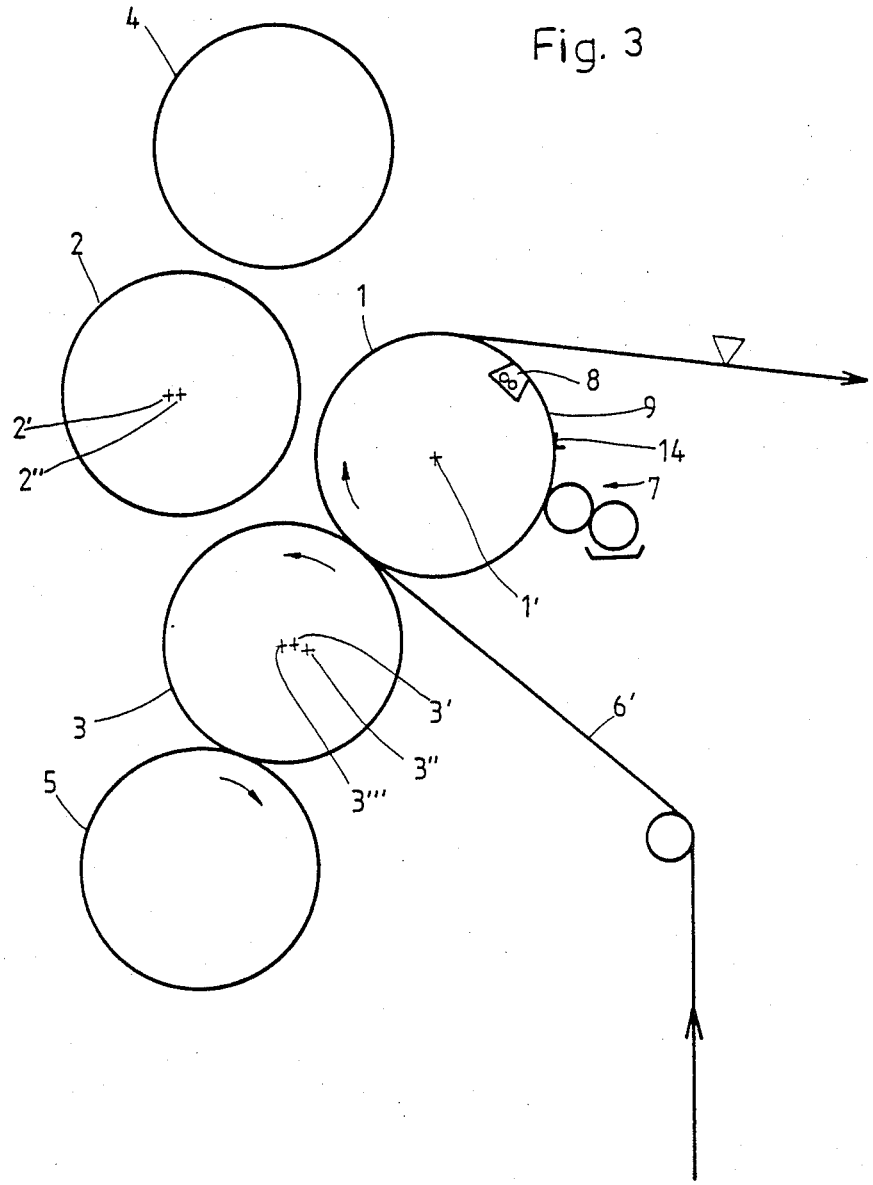

The axis 1' of the impression cylinder 1 is fixed in space. Two blanket cylinders 2, 3 can be engaged with the impression cylinder 1, as shown for example in FIG. 4. During operation, and to permit change of printing plates while the machine continues to print on a web, the respective blanket cylinders can be shifted in position for disengagement from each other and/or the impression cylinder 1. For example, and as seen in FIG. 2, blanket cylinder 3 can be shifted or removed from engagement with the impression cylinder 1 and remain spaced from the blanket cylinder 2. As seen in FIG. 3, blanket cylinder 2 can be placed in a removed position with respect to the impression cylinder 1 and remain spaced from blanket cylinder 3. In either case, a prime printing can be applied to a web 6' (FIGS. 2, 3) as indicated by the respective triangles in FIGS. 2 and 3 on the web 6', by using either the upper couple 2, 4 of blanket - plate cylinder (see FIG. 2) or the lower blanket cylinder - plate cylinder couple 3, 5 (see FIG. 3). The blanket cylinders 2 and 3 have plate cylinders 4, 5, respectively, associated therewith. It is not usually necessary to also slew the respective position of the plate cylinders; the plate cylinders should, however, be capable of being lifted off the respective blanket cylinders.

Figure 1:
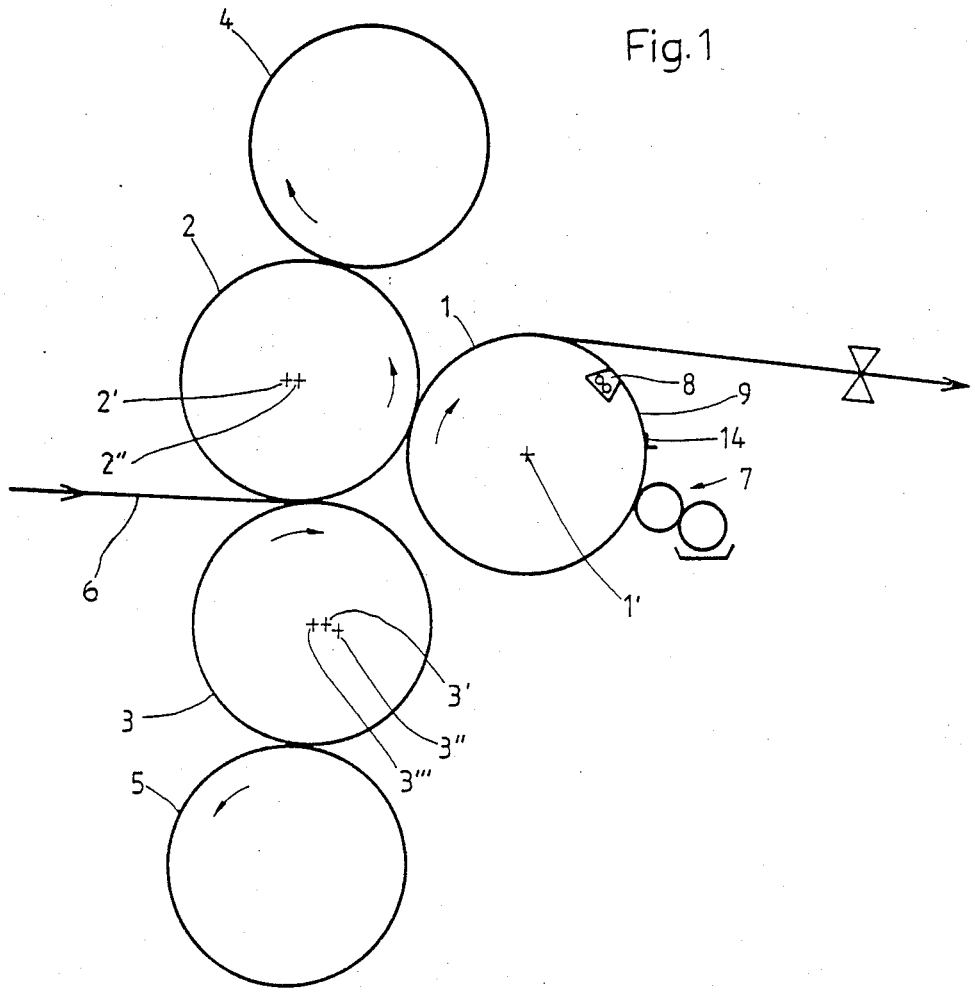

FIG. 1 illustrates an arrangement in which a paper web 6 is guided between two engaged blanket cylinders 2, 3 and, further, is partly looped about the impression cylinder 1. Impression cylinder 1 and blanket cylinder 2 are in engagement with each other. The respective direction of rotation of the cylinders is shown in the drawings by arrows. In the system illustrated, it is necessary to provide a drive to the blanket cylinder couple 3, 5 which can be reversed if the blanket cylinder 3 is to be engaged with the impression cylinder 1.

FIG. 1, thus, illustrates prime-and-verso printing (1/1). Ghosting is reliably prevented since the web 6 is passed not only between the blanket cylinders 2, 3 but, also is reliably guided by engagement between the blanket cylinder 2 and the impression cylinder 1.

The respective positions of the blanket cylinders 2, 3 in the respective operating modes are illustrated by prime notation. Position 2' of the axis of the cylinder 2 illustrates the disengaged or removed position of the cylinder 2 from the impression cylinder 1. The position 2" shows the location of the axis of the cylinder 2 when engaged with the impression cylinder 1. The impression cylinder 3 can shift between three positions. The position 3' shows the arrangement in which the blanket cylinder 3 is in engagement with the impression cylinder 1; the position 3" illustrates the location in which the blanket cylinder 3 is removed from both the impression cylinder 1 as well as from the blanket cylinder 2. In this position, the plate on plate cylinder 5 can be changed while printing is carried out between the blanket cylinder 2 and the impression cylinder 1. When the blanket cylinder 3 is so located that its axis is at the position 3''', the blanket cylinder 3 is engaged with the blanket cylinder 2 as illustrated, for example, in FIG. 1.

Preferably, the impression cylinder 2 has an axial clamping groove 8, and a rubber blanket 9 stretched thereover—see FIG. 1. This prevents a post-offsetting on the lower or verso side of the web 6 which might otherwise occur upon prime-and-verso printing (1/1). A washing arrangement 7, which washes the surface of a blanket on impression cylinder 1 further insures cleanliness and elimination of ghosts. A perforating strip 14 may be secured to the impression cylinder to perforate the web 6 either transversely or axially, or both, in accordance with well known placement of perforating strips.

Figure 4:
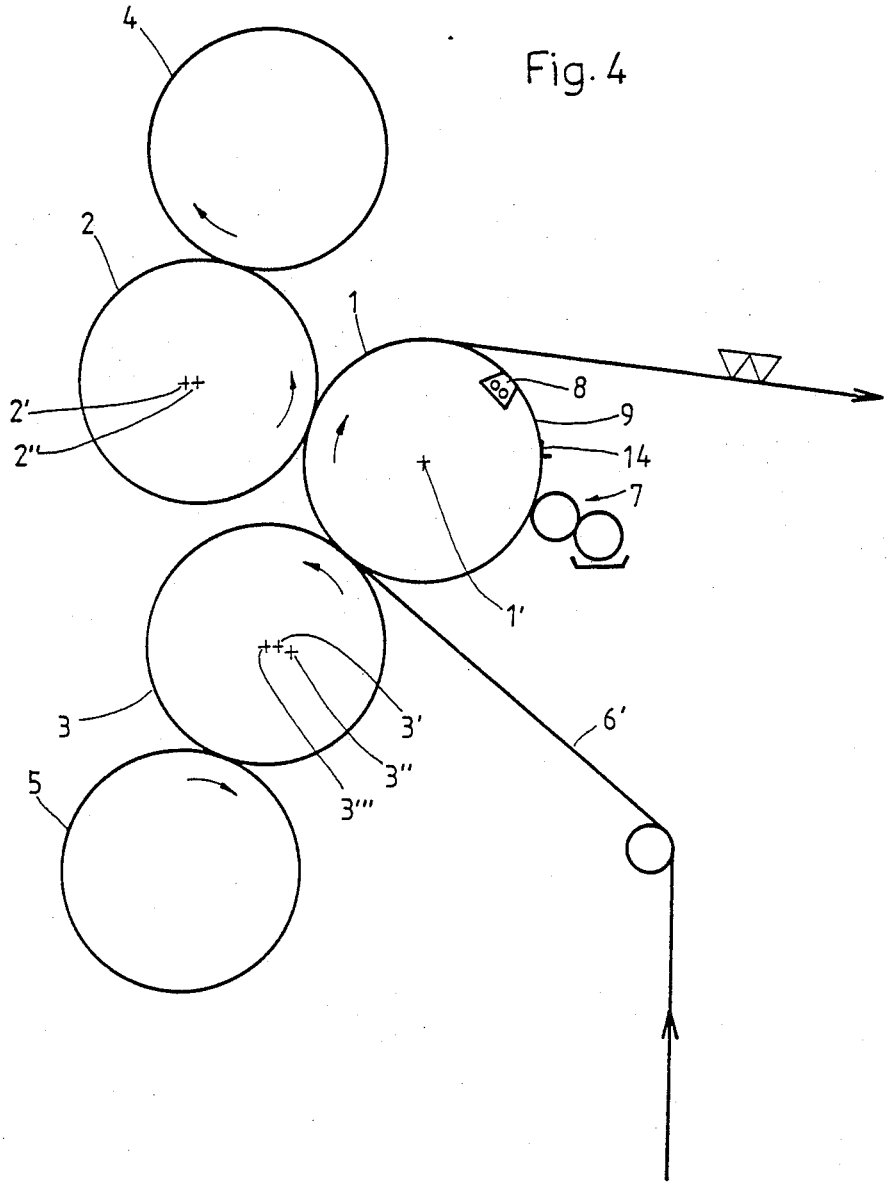

The path of the web can be changed. FIG. 2 illustrates the position of a web 6', guided, as well known, over an auxiliary guide roller, for single prime printing, with the position of the axis of the blanket cylinder 3 at the location 3''', that is, out of surface engagement with any other cylinder. FIG. 3 illustrates the same web guiding arrangement as in FIG. 2, with the blanket cylinder 3 engaged against the impression cylinder 1, rotating in opposite direction with respect thereto, and having its axis at the location 3'''. The blanket cylinder 2 is shown with its axis at the position 2', and the plate cylinder 4 is shown lifted off the blanket cylinder 2, for example for exchange of a plate on the plate cylinder 4 while the plate cylinder 5 prints its printing content via the blanket cylinder 3 on the web 6'. Two-color prime printing is shown in FIG. 4, in which the axis of the blanket cylinder 2 is at the position 2", and the axis of the blanket cylinder 3 is at the position 3" .

Figure 5:
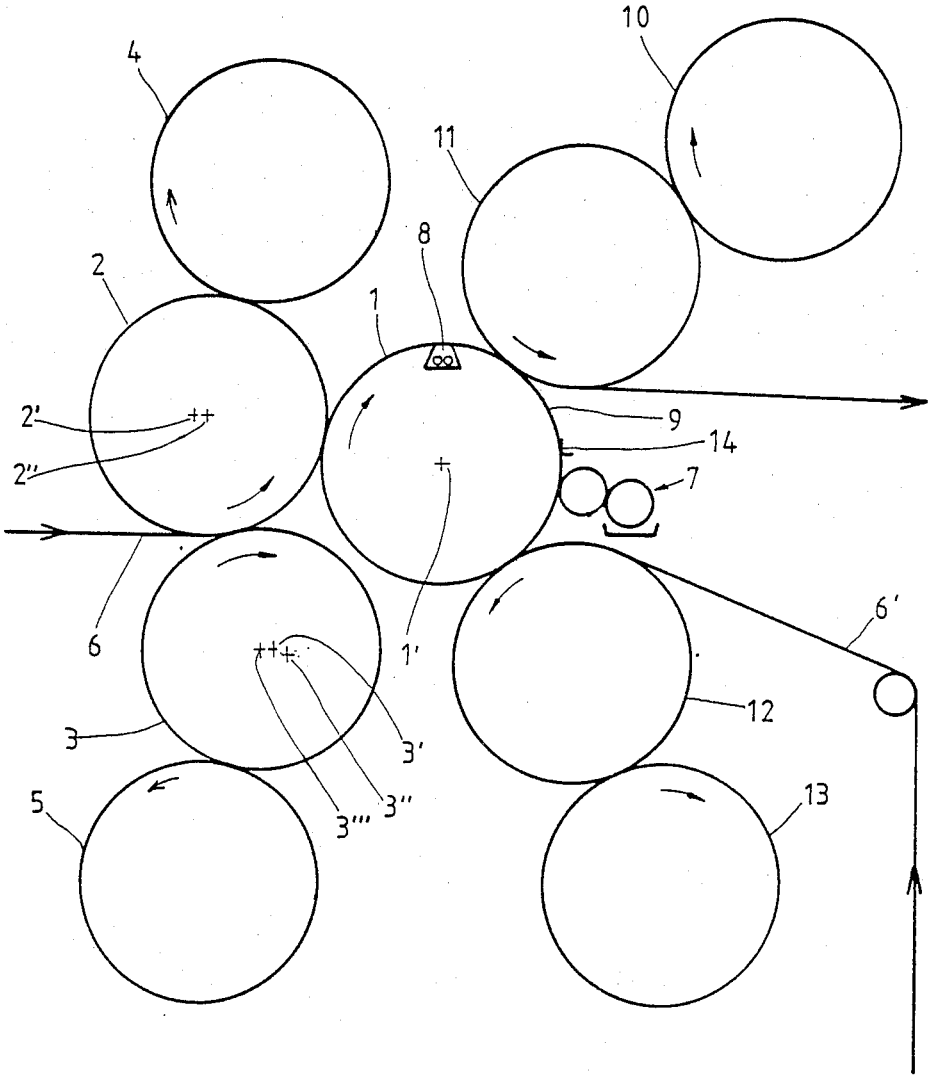

The system can be expanded by adding further blanket cylinder—plate cylinder couples. FIG. 5 illustrates the basic arrangement shown in FIGS. 1–4, with blanket - plate couples 11, 10 and 12, 13 added. The couple 11, 10 is located above a horizontal plane passing through the axis 1' of the impression cylinder, whereas the couple 12, 13 is located below that plane. The upper cylinder couple 11, 10 thus is located at an angle less than 180° with respect to the negative portion of the X-axis, having its origin at the center 1', and using the convention of measuring in counterclockwise direction. The web can be guided either as shown by the path of the web 6 between cylinders 2, 3, around the impression cylinder 1 and beneath the blanket cylinder 11 or, alternatingly, as shown by the feed of the web 6' between the blanket cylinder 12 and impression cylinder 1, blanket cylinder 2 and impression cylinder 1, and between blanket cylinder 11 and impression cylinder 1.

Figure 6:
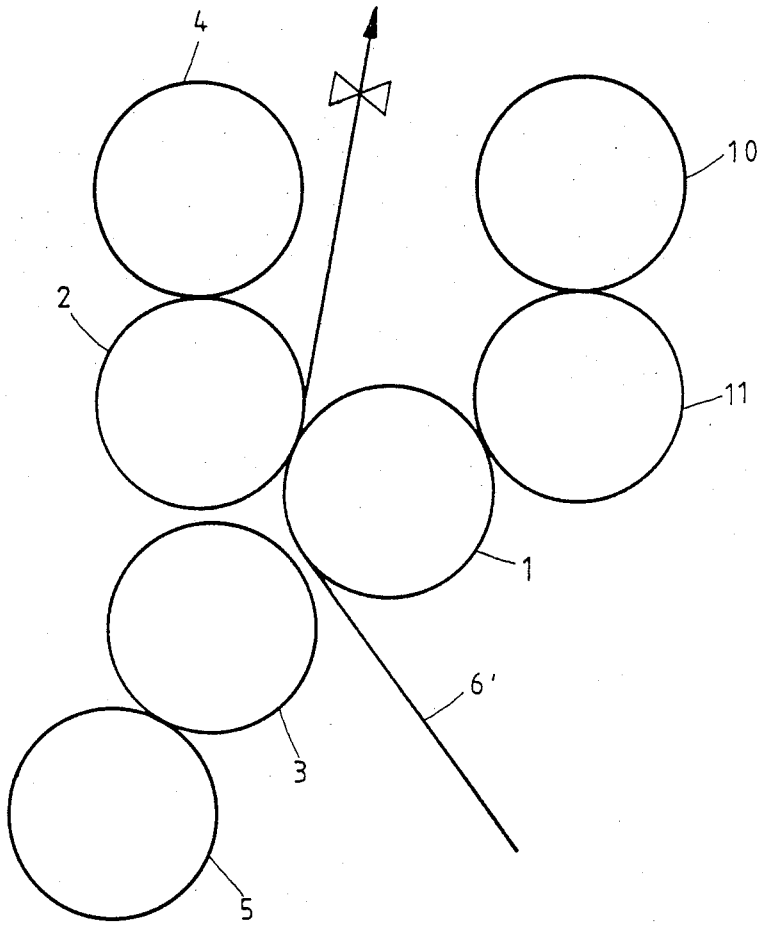
Figure 7:
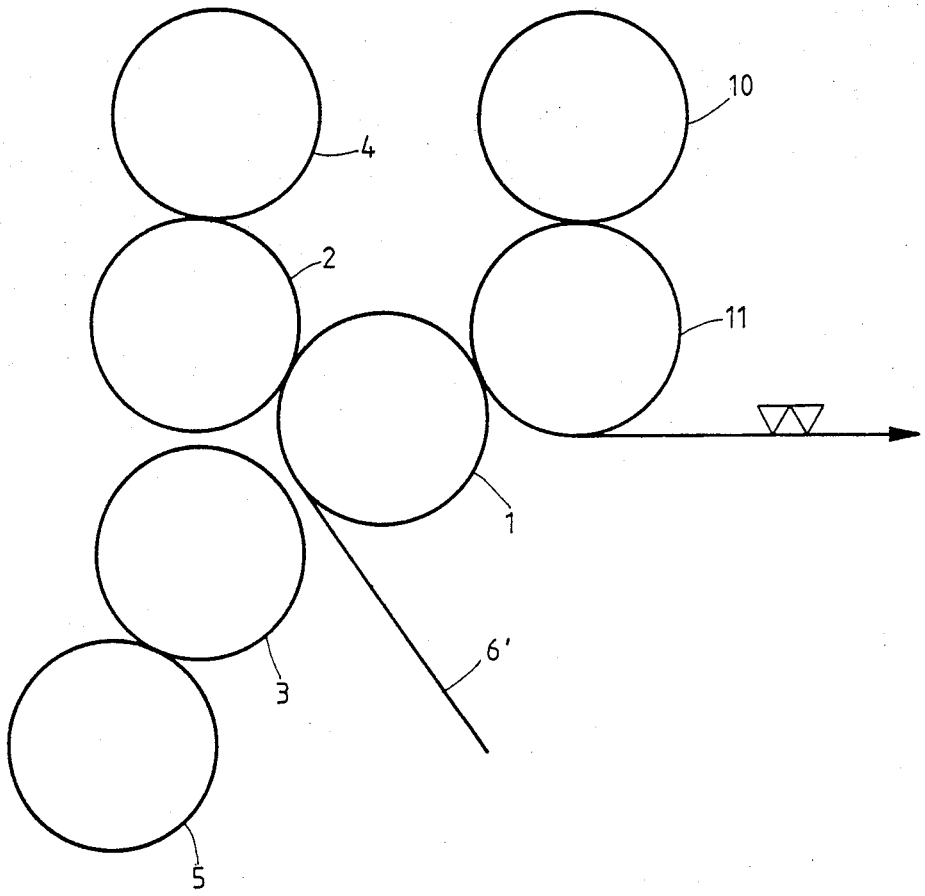
Figure 8:
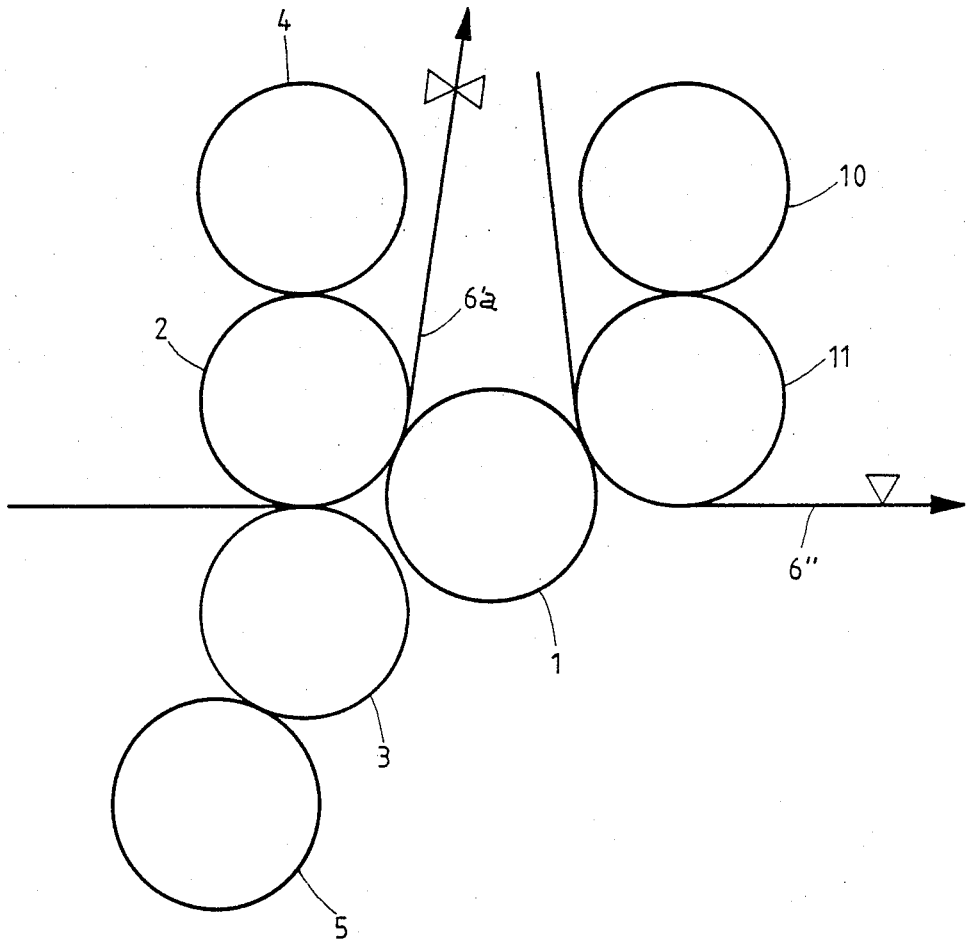
Figure 9:
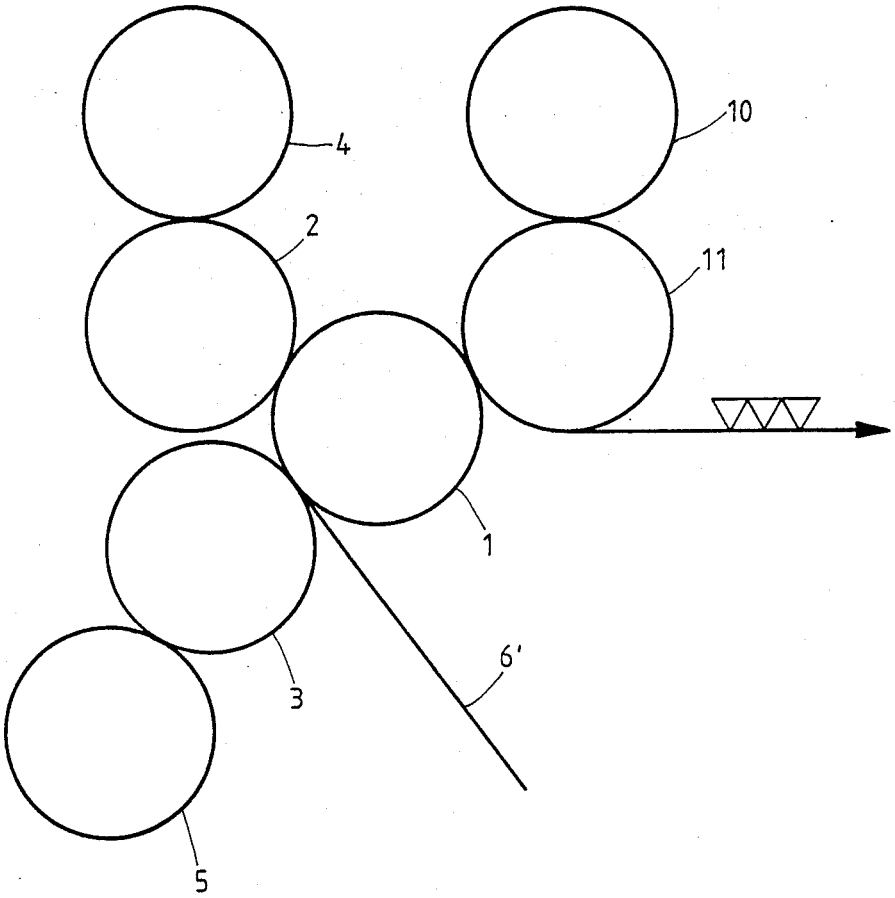
Figure 10:
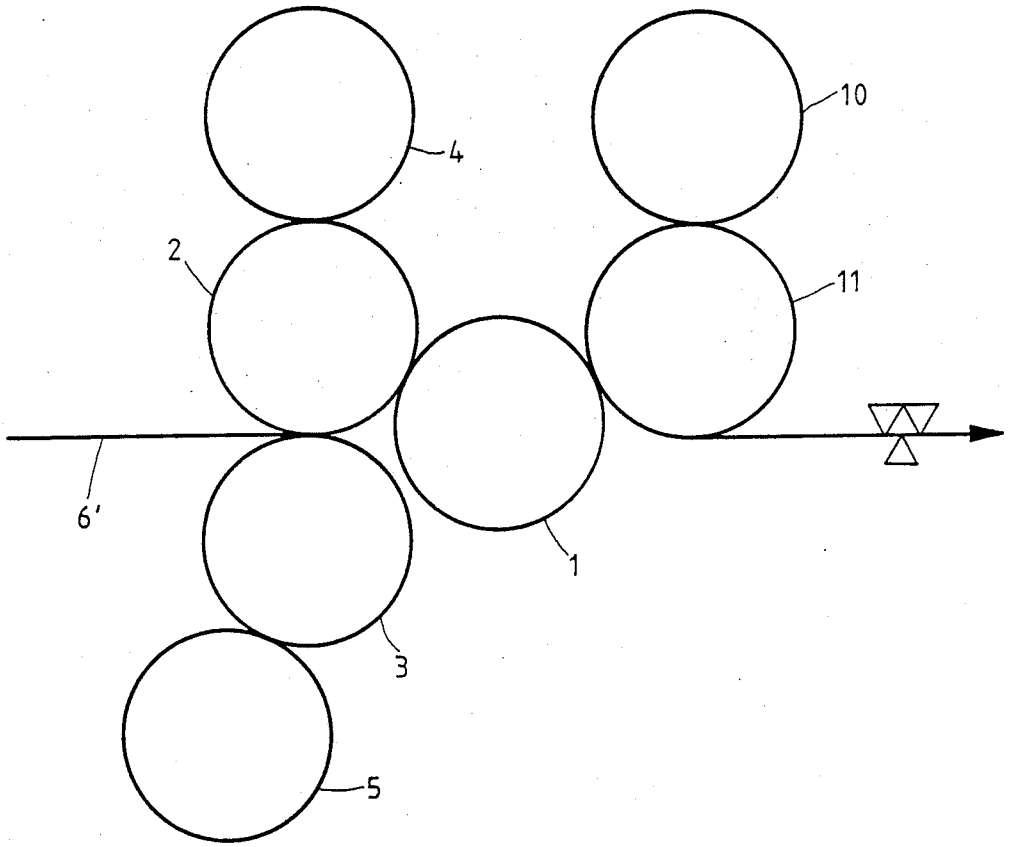

A seven-cylinder system shown in FIG. 6 is particularly suitable for newspaper printing. The arrangement of FIG. 6 provides for double-sided prime-and-verso or 1/1 printing. The prime printing side can readily be selectively printed by the blanket cylinder 2 or the blanket cylinder 3, and either plate cylinder 4 or 5 can be replaced or exchanged while the blanket cylinder in engagement with the other plate cylinder continues to print. The verso side in the arrangement of FIG. 6 is double-offset; the impression cylinder 1 carries a blanket which transfers the impression from plate cylinder 10 via blanket cylinder 11 on the blanket which is located on the impression cylinder 1 to effect verso printing against the blanket cylinder 2. The guidance of the web as shown in FIG. 7, in which the machine system is unchanged, illustrates how double prime printing can be effected while, again, permitting exchange of the plate on the respective plate cylinders 4 and 5 while the machine is in operation. The result wil be a 2/0 print. FIG. 8 illustrates use of the machine with two separately guided webs 6'a and 6". The web 6'a receives prime-and-verso printing and the web 6" is prime-printed only. FIG. 9 illustrates printing on a web 6', guided from below, three-color prime printing (3/0) applied, respectively, by the respective printing couples 2, 4; 3, 5 and 11, 10. FIG. 10 illustrates the arrangement of FIG. 9, with a different path of the web, and a different engagement of the respective cylinders. The cylinders 2, 3 are positioned as in FIG. 1, providing a single prime-and-verso printing. The cylinders 11, 10 provides a second prime printing, as seen in FIG. 10 to result in two-color prime and single-color verso printing (2/1).

The arrangement of FIG. 7 is particularly suitable for newspaper printing where certain advertising or headline material is to be highlighted by differently colored underlining or framing while permitting flying plate change.

Various changes and modifications may be made within the scope of the inventive concept, and positions and web paths may be varied, as appropriate, made possible by the versatile positioning of the respective cylinders.

I claim:

1. Versatile printing machine system comprising the combination of an impression cylinder (1) having a fixed axis of rotation, about which impression cylinder a paper web (6, 6', 6'a, 6'') is guided;

with at least two blanket cylinder - plate cylinder couples (2, 4; 3, 5) including a first blanket cylinder (2), a second blanket cylinder (3);

a first plate cylinder (4) and a second plate cylinder (5);

wherein the first blanket cylinder (2) has two axial locations (2', 2''), selectively alterable for engagement (2'') of said first blanket cylinder against the impression cylinder (1) or removed (2') from the impression cylinder; and the second blanket cylinder (3) has three axial locations (3', 3'', 3'''), selectively positioning said second blanket cylinder, (a) in engagement (3') with the impression cylinder (1);

(b) in engagement (3'' ) with the first blanket cylinder (2); or (c) removed (3'') from both the impression cylinder (1) and the first blanket cylinder (2), wherein the paper web is guided, selectively, (A) for prime-and-verso printing between the first and second blanket cylinders (2, 3) and about the impression cylinder (1) for guiding the web;

(B) for two-color prime printing about the impression cylinder (1) with both the first and second blanket cylinders engaged against the impression cylinder; and (C) for single prime printing (1/0) between one of said blanket cylinders (2, 3) and the impression cylinder (1), the other (2, 3) of the blanket cylinders being in removed position (3'', 2') out of engagement with the impression cylinder (1) and said one blanket cylinder to permit change of a printing plate on the plate cylinder (5, 4) associated with said other blanket cylinder while said one printing cylinder is printing on the web;

and wherein the axial locations of the first blanket cylinder (2) and of the second blanket cylinder (3) are independently selectable.

2. The system of claim 1, wherein the impression cylinder (1) and the blanket cylinders (2, 3) have the same diameter.

3. The system of claim 1, further comprising a washing unit (7) in engagement with the circumference of the impression cylinder for cleaning the surface thereof.

4. The system of claim 1, further including a rubber blanket (9) stretched about the impression cylinder (1).

5. The system of claim 1, further including a perforating means (14) located on the impression cylinder (1) for, selectively, providing for axial or transverse perforation of the paper web being passed thereabout.

6. The system of claim 1, further including at least one further blanket cylinder - plate cylinder couple (11, 10; 12, 13), the blanket cylinder of the respective couple being engageable with the impression cylinder.

7. The system of claim 6, wherein the axis of one of the at least one further blanket cylinders (11) is positioned above a horizontal plane passing through the axis of rotation (1') of the impression cylinder (1).

8. The system of claim 7, wherein the paper web (6') is looped partly about the impression cylinder (1) and wherein one of the first and second blanket cylinders (2, 3) is engageable therewith, and additionally at least one of the at least one further blanket cylinders is engageable therewith.

9. The system of claim 7, including a further paper web (6''), wherein the first paper web (6'a) is passed between the first and second blanket cylinders (2, 3) positioned in engagement against each other, and further between one (2)of said first and second blanket cylinders and the impression cylinder (1);

and wherein the further paper web (6'') is passed between at least one of the further blanket cylinders (11) and the impression cylinder (1).

10. The system of claim 7, wherein the paper web (6') is passed about the impression cylinder (1);

and wherein the first and second blanket cylinders (2, 3) and one (11) of the at least one further blanket cylinders are engaged with the impression cylinder (1).

11. The system of claim 10, further including a rubber blanket stretched about the impression cylinder (1).

12. The system of claim 7, wherein the paper web (6') is passed between the first and second blanket cylinders (2, 3) to apply a first prime and verso print;

and wherein one (11) of the at least one further blanket cylinder is engaged against the impression cylinder (1), with the paper web therebetween, to apply a second prime printing on the paper web, the paper web being partially looped about the impression cylinder.

* * * * *